US006263861B1

(12) United States Patent
Bootle

(10) Patent No.: US 6,263,861 B1
(45) Date of Patent: Jul. 24, 2001

(54) GOVERNOR

(75) Inventor: Geoffrey D Bootle, Maidstone (GB)

(73) Assignee: Delphi Technologies Inc., Troy, MI (US)

( * ) Notice: Subject to any disclaimer, the term of this patent is extended or adjusted under 35 U.S.C. 154(b) by 0 days.

(21) Appl. No.: 09/492,583

(22) Filed: Jan. 27, 2000

(30) Foreign Application Priority Data

Jan. 29, 1999 (GB) ..... 9901853

(51) Int. Cl.[7] ..... F02M 41/00; F02M 37/04; F02D 31/00

(52) U.S. Cl. ..... 123/450; 123/502; 123/372

(58) Field of Search ..... 123/372, 373, 123/450, 502

(56) References Cited

FOREIGN PATENT DOCUMENTS

| | | |
|---|---|---|
| 1 475 065 | 5/1973 | (GB) . |
| 1 579 334 | 6/1976 | (GB) . |
| 1 552 737 | 12/1977 | (GB) . |

*Primary Examiner*—Thomas N. Moulis
(74) *Attorney, Agent, or Firm*—Andrus, Sceales, Starke & Sawall

(57) ABSTRACT

A governor comprising a metering valve member slidable within a bore to control the degree by which an outlet is obscured, the valve member and bore together defining first and second chambers. The governor also comprises a restricted flow passage whereby fuel can flow from the first chamber to the second chamber at a restricted rate, and a control valve controlling communication between the second chamber and a low pressure reservoir. The control valve is adjustable by means of a centrifugal weight mechanism.

8 Claims, 3 Drawing Sheets

10
18
19
20
21
22
23
24
25
26
28
29
30
31
32
33
34
35

GOVERNOR

This invention relates to a governor suitable for use in controlling the quantity of fuel supplied to a cylinder of an associated internal combustion engine.

In known governor arrangements for use in controlling the operation of the engines of alternator and generator sets, a centrifugal weight mechanism is arranged to be rotated at a speed associated with the operating speed of the engine. The weight mechanism acts against a lever which is spring biased towards a rest position. The lever is coupled to the valve member of a throttle or metering valve. In use, upon the speed of operation of the engine varying due to a change in load, the force applied to the lever by the weights varies resulting in the lever moving. The change in position of the lever results in the setting of the metering valve changing. In use, the quantity of fuel supplied through the metering valve is arranged to reduce with increasing engine speed. As a result, the engine is controlled in such a manner as to operate at a near constant speed.

Variations in the spring rate and in the geometry of other components of the governor may result in the presence of differences in the operation of governors of identical nominal specifications. Further, the performance of a particular governor may vary, for example as a result of wear. It is an object of the invention to provide a governor suitable for use with an engine intended to be operated at near constant speed in which the effects of these disadvantages are mitigated.

According to the present invention there is provided a governor comprising a metering valve member slidable within a bore to control the degree by which an outlet is obscured, the valve member and bore together defining first and second chambers, a restricted flow passage whereby fuel can flow from the first chamber to the second chamber at a restricted rate, and a control valve controlling communication between the second chamber and a low pressure reservoir, the control valve being adjustable by a centrifugal weight mechanism.

The restricted flow passage is conveniently defined by a passage extending through the metering valve member.

The invention will further be described, by way of example, with reference to the accompanying drawings, in which.

Figures 1, 2, 3, 4:
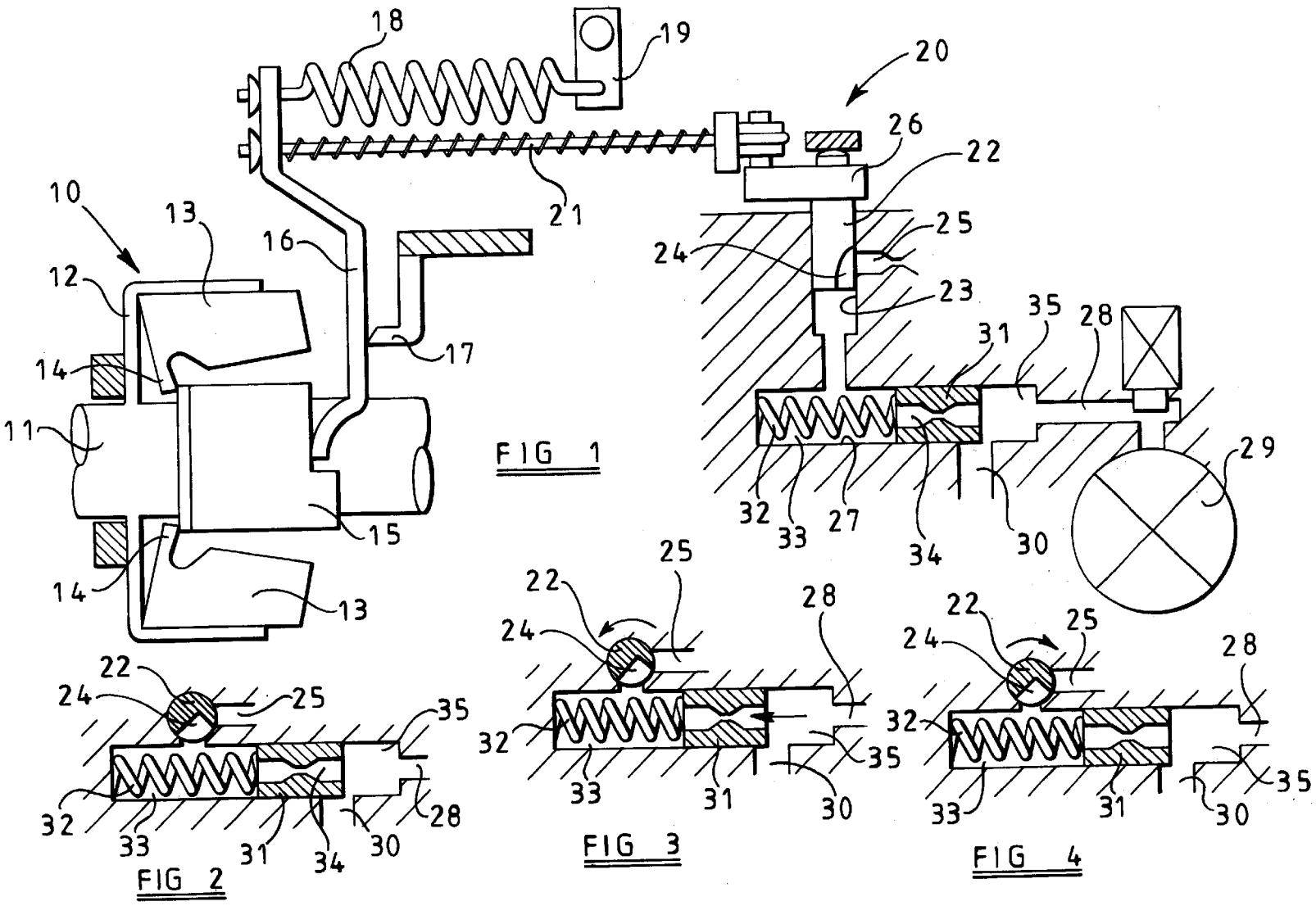
FIG. 1 is a diagrammatic view illustrating a governor in accordance with an embodiment of the invention.
FIGS. 2 to 6 are diagrams illustrating the operation of the governor of FIG. 1.

Referring to the accompanying drawings, a governor is illustrated for use in controlling the quantity of fuel supplied to a high pressure fuel pump of the rotary distributor type for use in supplying fuel under high pressure to the cylinders of a compression ignition internal combustion engine. The governor arrangement is intended for use with engines for alternator and generator sets.

The governor comprises a centrifugal weight mechanism 10 mounted upon a shaft 11 arranged to rotate at a speed associated with the speed of operation of the engine. The shaft 11 may, for example, rotate at cam shaft or crank shaft speed. The centrifugal weight mechanism 10 comprises a cage 12 mounted upon the shaft 11 and arranged to support a plurality of weights 13. The cage 12 and weights 13 are arranged to rotate with the shaft 11. Each of the weights 13 is pivotable between a radially inner position and a radially outer position, the outer position being illustrated. Each weight 13 includes a projection 14 which is arranged to engage an end surface of a sleeve 15 which is movable axially relative to the shaft 11. The sleeve 15 acts upon a lever 16 which is pivotable about an arm 17.

At its end remote from the sleeve 15, the lever 16 is secured to a governor spring 18, the spring 18 being coupled to a throttle lever 19 which is pivotally mounted to a housing, and adjustable to vary the preload applied to the lever 16 by the governor spring 18. The governor spring 18 biases the sleeve 15 towards a position in which the weights 13 occupy their radially inward position. In use, upon the shaft 11 rotating at a speed greater than a predetermined speed, the centrifugal force applied to the weights 13 as they rotate with the shaft 11 causes the weights 13 to move towards their radially outer position, moving the sleeve 15 and lever 16 against the action of the governor spring 18.

The lever 16 is coupled to a control valve 20 through a conventional coupling arrangement 21. The control valve 20 comprises a valve member 22 located within a bore 23. The valve member 22 is provided with a recess 24 located such that in a first angular position of the member 22 within the bore 23, the member 22 obscures an outlet passage 25, the valve member 22 being angularly adjustable to a position in which the outlet opening 25 communicates through the recess 24 with the interior of the bore 23. In order to transmit movement of the lever 16 to the valve member 22, a crank member 26 is secured to the upper end of the valve member 22, the coupling arrangement 21 being secured to the crank 26. The outlet passage 25 communicates with the interior of a cam box which contains fuel at relatively low pressure. The passage 25 may include a region of relatively small diameter arranged to limit the rate at which fuel is able to flow towards the cam box. Although in the arrangement of FIG. 1, the cam box is used as a low pressure fuel reservoir, it will be appreciated that the invention is also applicable to arrangements in which the low pressure reservoir takes other forms.

The interior of the bore 23 communicates with a second bore 27, the bore 27 communicating through a passage 28 with the outlet of a transfer pump 29, conveniently of the vane type, which is arranged to operate at a speed associated with the speed of operation of the engine and which has an outlet pressure related to engine speed. The bore 27 further communicates with an outlet 30 which communicates with the inlet of the high pressure fuel pump. A solenoid valve is associated with the passage 28 and/or pump 29 and arranged to terminate the supply of fuel when the engine is to be shut down.

A metering valve member 31 is slidable within the bore 27, the valve member 31 being biased by a light, low rate spring 32 towards a position in which the valve member 31 obscures the outlet 30, substantially preventing fuel from flowing from the passage 28 to the outlet 30.

The valve member 31 and bore 27 together define a first chamber 35 which communicates with the passage 28, and a second chamber 33 within which the spring 32 is located and which communicates with the interior of the bore 23. The second chamber 33 communicates with the first chamber 35 through a passage 34 provided in the valve member 31. The passage 34 is shaped to include a region of relatively small diameter which acts to limit the rate at which fuel can flow through the passage 34 towards the second chamber 33.

In use, as illustrated in FIG. 2, with the engine operating at a given steady speed determined by the position of the throttle lever 19, the metering valve member 31 will occupy a position in which the outlet 30 is partially obscured, and fuel flows towards the high pressure fuel pump at a rate governed by the degree by which the outlet 30 is obscured. In order for the valve member 31 to be maintained in this position, the action of the fuel within the first chamber 35 upon the surface of the valve member 31 which faces the passage 28 must be equal to the action of the fuel pressure within the second chamber 33 and the action of the spring 32. The action of the fuel under pressure within the second chamber 33 is dependent, to some extent, upon the rate at which fuel is able to flow through the passage 34 to the second chamber 33 and the rate at which fuel is able to escape from the second chamber 33 through the recess 24 and the outlet passage 25. In order for the valve member 31 to be held in a steady position, then the rate at which fuel is flowing to the second chamber 33 must be substantially equal to the rate at which fuel is able to escape from the chamber 33.

In the event that the load on the engine increases, the speed of operation of the engine will fall. As a result, the force applied to the lever 16 by the centrifugal weight arrangement 10 will fall, and the lever 16 will move under the action of the governor spring 18 to move the valve member 22 to a position in which fuel is able to escape from the second chamber 33 through the recess 24 and passage 25 at an increased rate. As a result of fuel being able to escape at an increased rate, the fuel pressure within the second chamber 33 will fall. The reduced fuel pressure within the second chamber 33 will be unable to maintain the valve member 31 in its previous steady state position, and the valve member 31 will move towards the left, in the orientation illustrated, as shown in FIG. 3. As a result, a greater cross-sectional area of the entrance to the outlet 30 becomes available for fuel flow, and fuel is therefore able to flow towards the high pressure fuel pump at an increased rate. The increase in fuel flow to the high pressure fuel pump results in fuel being delivered to the engine at an increased rate. The engine speed will thus increase. The increased engine speed causes the weights 13 of the centrifugal weight mechanism 10 to move towards radially outer positions, this movement being transmitted through the sleeve 15 and lever 16, against the action of the governor spring 18 to the valve member 22 as illustrated in FIG. 4, returning the governor to a steady state condition in which the engine is operating at substantially its originally speed, but against a higher load.

Figures 5, 6, 7:
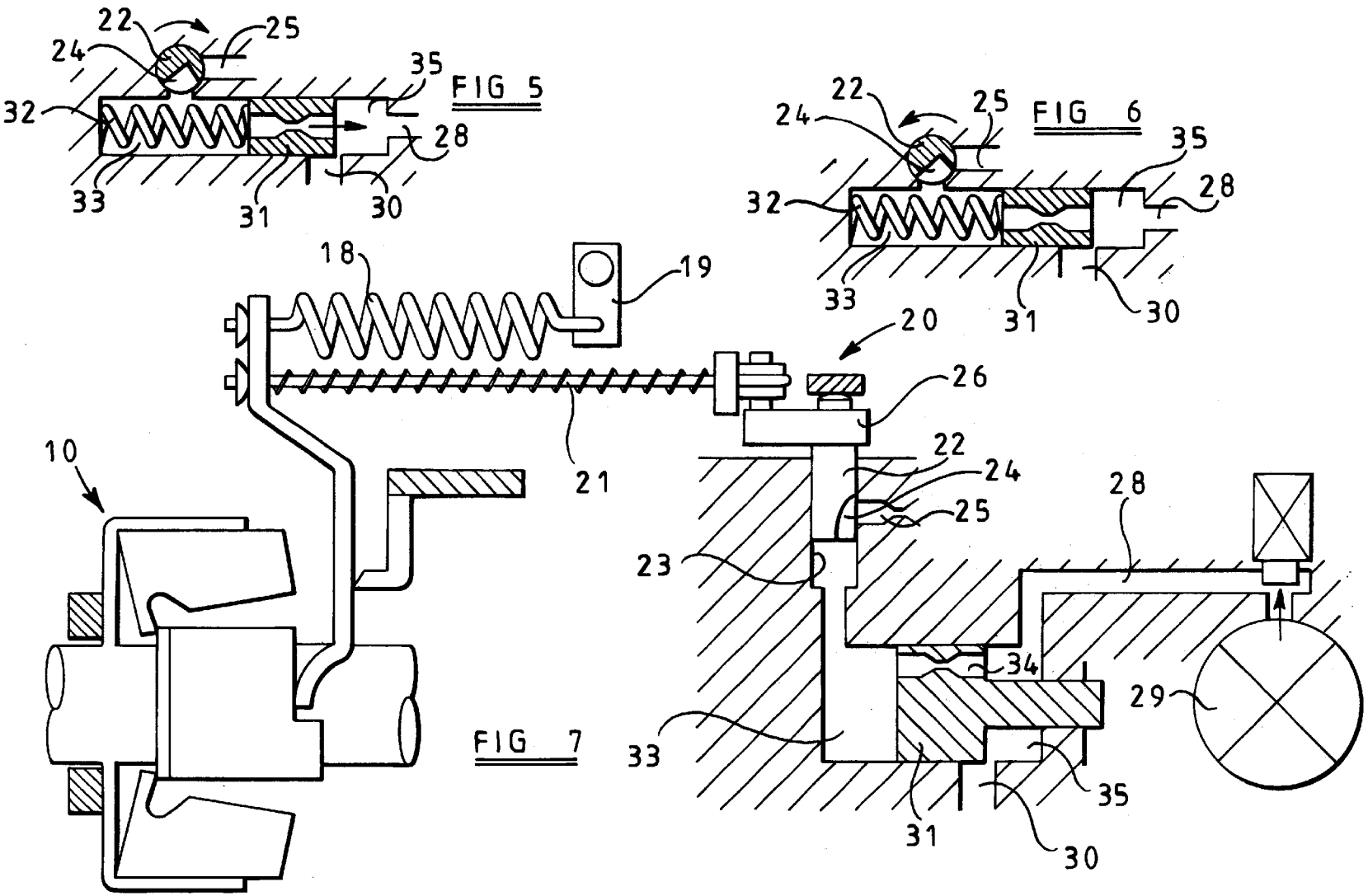
FIGS. 7 and 8 are views similar to FIG. 1 illustrating alternative embodiments.

FIGS. 5 and 6 illustrate the effect of the load upon the engine falling. As illustrated in FIG. 5, upon the engine load falling, the speed will increase, and as discussed hereinbefore, the effect of the engine speed increasing is that the weights move radially outward, and as a result the control valve member 22 moves towards a closed position. In the steady state condition illustrated in FIG. 2, the control valve member 22 occupies an almost closed position, and as illustrated in FIG. 5, upon the load falling, the control valve member 22 moves to a fully closed position. The continued flow of fuel at a restricted rate through the passage 34 results in the fuel pressure within the second chamber 33 rising, the increased fuel pressure within the second chamber 33 in conjunction with the action of the spring 32 permitting the metering valve member 31 to move as indicated by the arrow in FIG. 5 to the position illustrated in FIG. 6. In this position, the rate at which fuel is able to flow to the high pressure fuel pump is reduced. The quantity of fuel supplied to the engine therefore falls, and as a result, the engine speed falls. As discussed hereinbefore, upon the engine speed falling, the weights 13 move towards radially inner positions under the action of the spring 18. The control valve member 22 then moves towards its slightly open, steady state position, thus controlling the engine is such a manner as to ensure that the engine operates at substantially its original speed but against a reduced load.

The fuelling levels achieved after adjustment resulting from either an increase or a decrease in the engine load are such as to achieve an engine speed substantially equal to the engine speed prior to the change in engine load. The rate at which the engine speed changes is determined by the rate at which the valve member 31 moves, and this depends upon the rate of the spring 32 and the relative dimensions of the restrictions to flow formed by the passage 34 and the passage 25. These parameters can be chosen depending upon the application in which the governor is to be used.

FIG. 7 illustrates an embodiment which is similar to that of FIG. 1 but in which the valve member 31 takes the form of a differential piston, the area of the valve member 31 exposed to the fuel pressure within the first chamber 35 being smaller than that exposed to the fuel pressure within the second chamber 33. In such an arrangement, the spring 32 can be omitted. Such an arrangement provides near isochronous governing.

Figure 8:
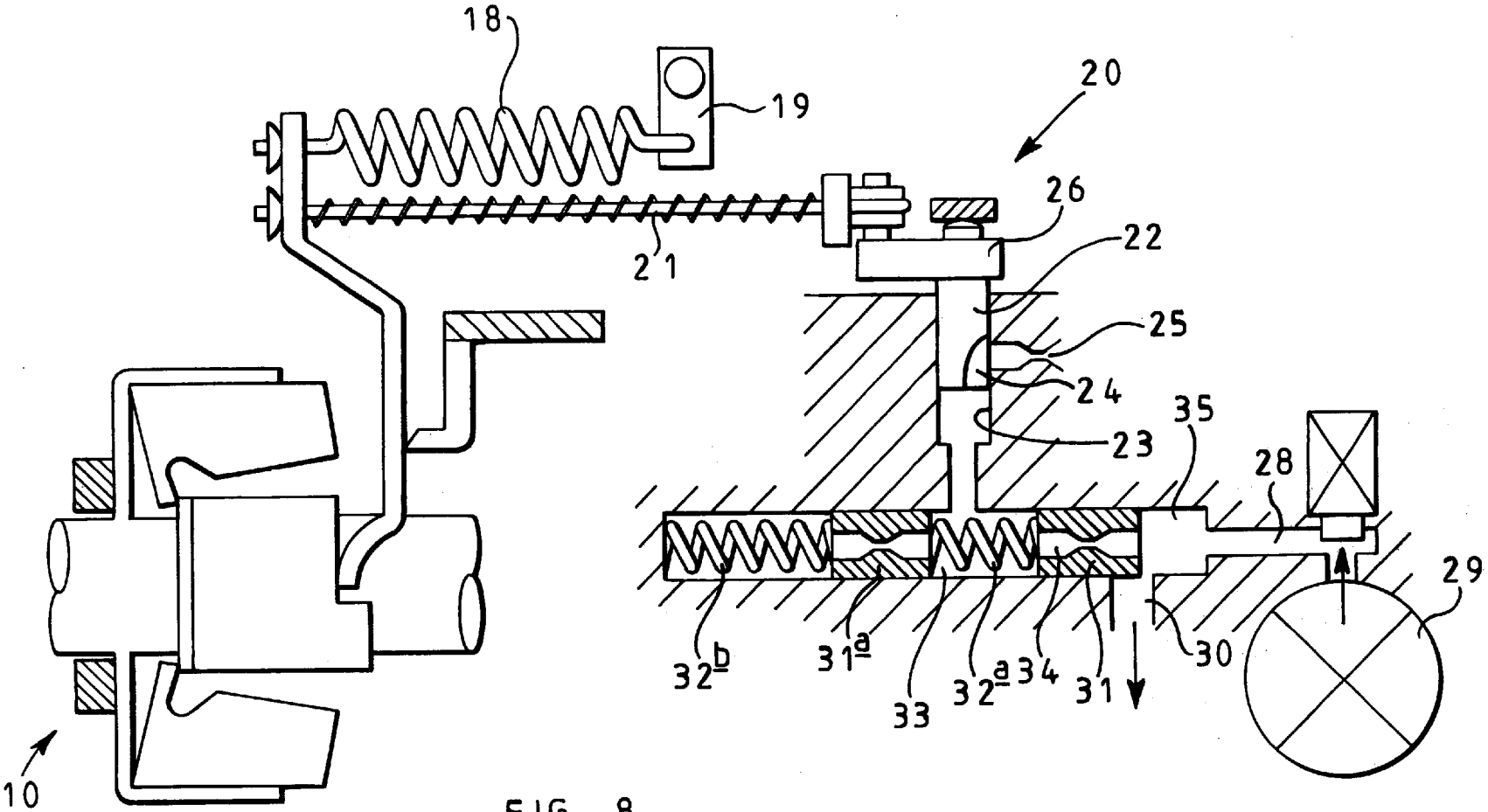

In the arrangement of FIG. 8, rather than biasing the valve member 31 using a light spring 32, a relatively stiff spring 32*a* engages the valve member 31, the spring 32*a* further engaging a stabilizer piston 31*a* of form similar to that of the valve member 31. A light spring 32*b* urges the piston 31*a* towards a rest position. The use of a stabilizer piston in governor systems which are vulnerable to instability is known, the stabilizer piston typically acting upon the lever of a governor arrangement. As, in accordance with the invention, the governor does not control fuelling levels directly, the fuelling levels being controlled through the intermediary of the valve member 31, in the arrangement of FIG. 8 the stabilizer piston 31 *a* is arranged to stabilize the valve member 31 rather than the lever of the governor.

In the arrangements illustrated and described hereinbefore, the governor spring 18 may be of a very high rate. As a result, the governor arrangement illustrated in FIG. 1 may be used in arrangements which operate at both 50 and 60 Hz. It will be appreciated that this is achieved by effectively separating the engine speed sensitive part of the governor from the part which controls the rate at which fuel is supplied to the fuel pump. Where these functions are not separated from one another, the governor spring 18 must be of relatively low rate to achieve the desired level of droop. In the arrangement of the invention, the governor spring 18 can be of higher rate, the size of the passage 34 and any spring biasing of the valve member 31 controlling the level of droop.

What is claimed is:

1. A governor for use in controlling the quantity of fuel supplied to an associated engine comprising a metering valve member slidable within a bore to control the degree by which an outlet is obscured, said valve member and said bore together defining first and second chambers, a restricted flow passage whereby fuel can flow from said first chamber to said second chamber at a restricted rate, and a control valve controlling communication between said second chamber and a low pressure reservoir, said control valve being adjustable by means of a centrifugal weight mechanism, wherein the outlet is arranged so that in use, fuel flows through said outlet towards the associated engine.

2. The governor as claimed in claim 1, wherein said restricted flow passage is defined by a passage extending through said metering valve member.

3. The governor as claimed in claim 1, wherein said control valve comprises a valve member which is located within a bore, said control valve having an angular position within said bore which is adjustable to control communication between said second chamber and said low pressure reservoir.

4. The governor as claimed in claim 1, wherein said metering valve member is biased by means of a first spring into a position in which said metering valve member obscures said outlet.

5. The governor as claimed in claim 1, further comprising a stabiliser piston which acts on said metering valve member.

6. The governor as claimed in claim 5, wherein said stabiliser piston is biased by means of a further spring to act on said metering valve member.

7. The governor as claimed in claim 6, wherein said first spring is relatively stiff compared to said further spring.

8. The governor as claimed in claim 1, wherein said metering valve member takes the form of a differential piston.

* * * * *